United States Patent [19]

Lapadakis

[11] Patent Number: 4,700,906

[45] Date of Patent: Oct. 20, 1987

[54] PAPER TAPE CONTROL UNIT

[76] Inventor: Theodore P. Lapadakis, 9827 Mason Ave., Chatsworth, Calif. 91311

[21] Appl. No.: 28,191

[22] Filed: Mar. 19, 1987

[51] Int. Cl.[4] ..... B65H 16/06; B65H 18/14

[52] U.S. Cl. ..... 242/67.3 R; 242/75.4; 235/58 CF; 400/614

[58] Field of Search ..... 242/67.3 R, 67.2, 67.4, 242/67.1 R, 75.4, 99; 235/58 CF; 400/614, 614.1

[56] References Cited

U.S. PATENT DOCUMENTS

| | | | |
|---|---|---|---|
| 1,131,849 | 3/1915 | Magnus . | |
| 1,347,884 | 7/1920 | White et al. . | |
| 1,436,218 | 11/1922 | Tindall et al. . | |
| 1,537,971 | 5/1925 | Sundstrand | 242/67.3 R |
| 1,604,794 | 10/1926 | Sutton | 242/67.3 R |
| 1,762,749 | 6/1930 | Tauschek | 400/614 |
| 1,825,783 | 10/1931 | Dunning . | |
| 3,338,531 | 8/1967 | Novotny | 242/67.3 R |
| 3,447,657 | 6/1969 | Majors | 242/67.1 R |
| 3,652,027 | 3/1972 | Wong | 242/99 |
| 3,738,685 | 6/1973 | Penner | 242/67.3 R |
| 4,116,468 | 9/1978 | Marten | 242/67.4 |
| 4,135,676 | 1/1979 | Hunter | 242/67.2 |
| 4,168,038 | 9/1979 | Nims | 242/67.3 R |
| 4,469,287 | 9/1984 | Pfister | 242/67.3 R |
| 4,492,345 | 1/1985 | Bakker | 242/67.3 R |
| 4,494,708 | 1/1985 | Stubbs | 242/67.3 R |

*Primary Examiner*—John M. Jillions

*Attorney, Agent, or Firm*—Kelly, Bauersfeld & Lowry

[57] ABSTRACT

An improved control unit is provided in the form of a compact and relatively simple add-on kit for use with calculators, adding machines and the like requiring use of paper tape in roll form. The paper tape control unit supplies the paper tape to the associated machine and rewinds that tape in a continuously controlled manner while permitting relatively easy periodic reversal of tape motion for review purposes. The control unit includes supply and take-up reels driven together by a drive belt adapted for sufficient slipping motion to accommodate diametric size changes in the reels as the tape is unwound and wound with respect thereto. An adjustable platen is supported by the control unit in a position for passage of imprinted tape thereover to facilitate placement of manual edits or notations prior to winding of the tape onto the take-up reel. A relatively simple locking assembly is provided for locking the supply reel against rotation while permitting manual reversal of take-up reel rotation to draw off paper tape from the take-up reel for review purposes without creating undesirable slack in the tape supplied from the supply reel.

20 Claims, 8 Drawing Figures

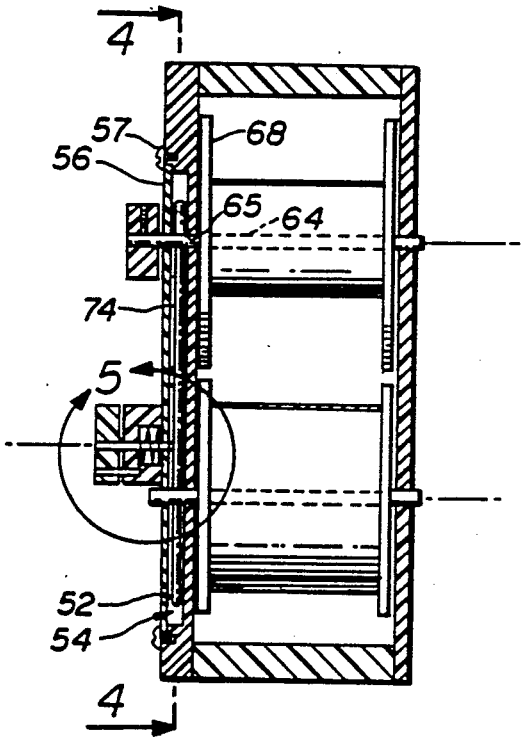
FIG. 3
FIG. 4
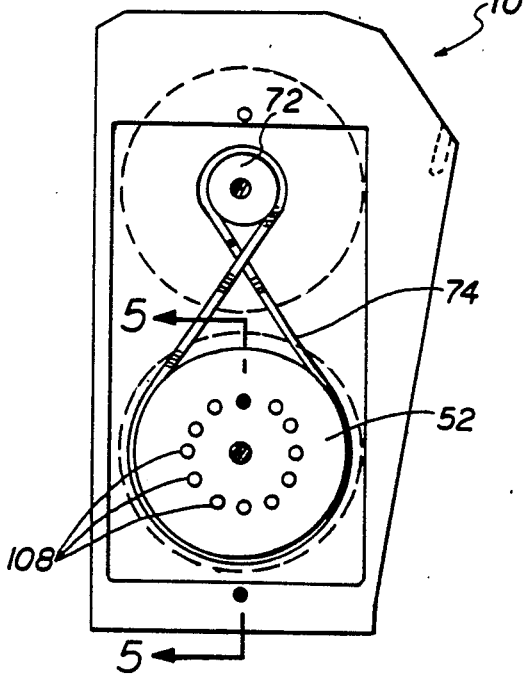
FIG. 5
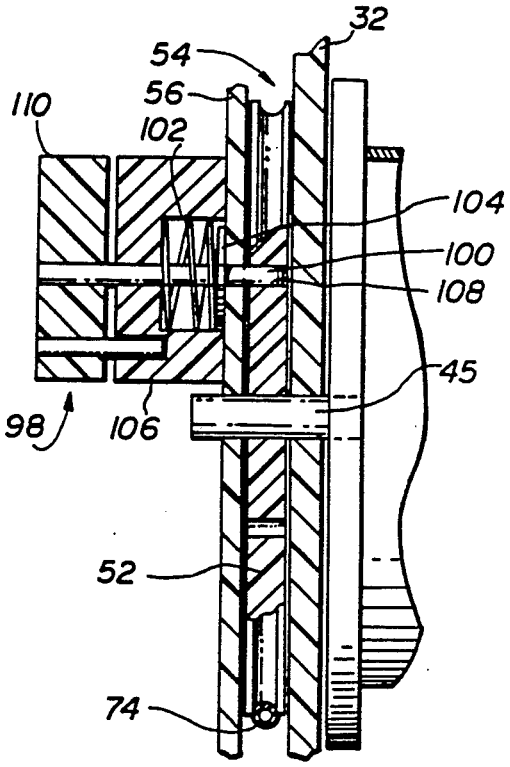
FIG. 6
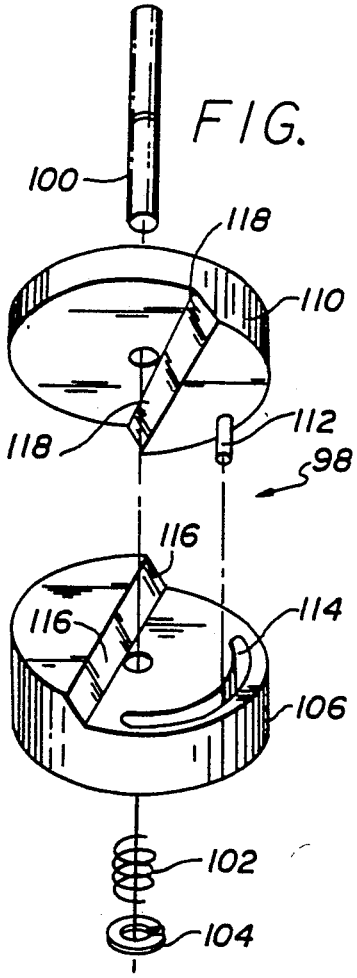

PAPER TAPE CONTROL UNIT

BACKGROUND OF THE INVENTION

This invention relates generally to improved apparatus for handling elongated paper roll tape of the type used with adding machines, calculators, and the like. More particularly, this invention relates to an improved yet relatively simple paper tape control unit for supplying paper tape to and for simultaneously rewinding paper tape discharged from an adding machine or calculator or the like.

Adding machines and calculators and other types of business machines are well-known of the type utilizing elongated strips of so-called paper tape. Typically, an elongated strip of paper tape is supplied in roll form and mounted on the adding machine or calculator, etc., by means of a rotatable spindle which permits the tape to be unrolled for supply to the business machine. The business machine commonly includes a roller platen unit or a similar mechanism for drawing the tape incrementally from the supply reel into association with a suitable printing head which applies numbers, letters, etc., into the paper tape. In most cases, the paper tape is permitted to discharge from the machine freely in an unrestrained manner which commonly results in elongated, tangled strips of paper tape which fall onto the floor in an unsightly manner.

A wide variety of paper tape control devices have been proposed for use with adding machines and calculators and the like, particularly to include a take-up reel onto which used paper tape is rewound simultaneously with unwinding of the tape from the supply reel. Many such paper tape control devices are integrated directly into the associated business machine, thereby providing a relatively large and complicated business machine construction, while other paper tape control devices have been designed as add-on components for association with a separate business machine. In general, however, these add-on components have also been relatively complex in construction and operation to include, for example, separate and relatively costly drive motors for winding the tape take-up reel. See, for example, U.S. Pat. Nos. 3,338,531 and 3,447,657. Other relatively simplified add-on control devices have attempted to drivingly interlink tape supply and take-up reels, for example, by use of friction roll-drive therebetween, but such devices have not adequately accounted for the inversely varying reel diameters as tape movement progresses, thereby frequently resulting in undesired or uncontrolled tape slack. Moreover, these devices have not facilitated rapid and simple review of used tape, nor have such devices provided a simple means for applying handwritten notes or edits to the used tape.

There exists, therefore, a significant need for an improved paper tape control device, particularly in the form of an add-on kit for use with existing calculators, adding machines and other business machines, wherein the control unit provides accurate, relatively slack-free paper tape motion control while permitting review of used tape and further accommodating the application of handwritten notes or edits to the used tape. The present invention fulfills all of these needs and provides further related advantages.

SUMMARY OF THE INVENTION

In accordance with the invention, an improved paper tape control unit is provided for positioning or for releasable attachment in operative association with a calculator, adding machine, or other business machine requiring paper tape in roll form. The improved control unit includes a paper tape supply reel from which paper tape is drawn as required for use in the business machine. The control unit further includes a take-up reel which is driven by the supply reel motion for rewinding used paper tape discharged from the business machine.

In accordance with a preferred form of the invention, the improved paper tape control unit comprises a relatively compact housing with upstanding side walls having the paper tape supply and take-up reels rotatably supported therebetween generally in parallel relation. The housing defines an open front through which the paper tape is wound from the supply reel and rewound onto the take-up reel. Drive belt means such as an elongated spring belt interconnects the supply and take-up reels for appropriate directional driving to unwind and wind the paper tape, respectively. Importantly, the drive interconnection between the supply and take-up reels is designed to rotate the take-up reel at a faster speed than required to prevent tape slack, and the drive belt means is designed to permit slipping motion between the supply and take-up reels. With this construction the take-up reel is driven at all times in a manner preventing tape slack, while the drive belt means permits sufficient slipping motion to prevent tape breakage.

An adjustable platen unit is supported by the housing side walls in a position generally spanning the open front of the housing. This adjustable platen unit includes a relatively broad and generally flat wiring surface disposed above the business machine and adjusted for relatively smooth passage of the paper tape over the writing surface upon tape movement for rewinding to the take-up reel. Accordingly, the writing surface provides a convenient support surface backing the tape to permit manual edits or notations onto the tape upon discharge thereof from the business machine. A pivoting adjustment leg forming a portion of the platen unit accommodates angular adjustment in the writing surface position for optimal match with the angle of tape discharge from the business machine.

A locking assembly is mounted on one side wall of the control unit housing and includes means for quickly and easily engaging the supply reel to prevent rotation thereof. Accordingly, actuation of the locking assembly effectively prevents further feeding or unrolling of the paper tape for supply to the business machine. When the supply reel is locked against rotation, the paper tape rewound onto the take-up reel can be manually grasped and drawn off the take-up reel for review, wherein take-up reel rotation is permitted by the slip-drive connection between the take-up and supply reels. A side slot in the writing surface conveniently exposes one edge of the paper tape for easy grasping during tape withdrawal from the take-up reel. A winding knob on one side wall of the control unit housing permits manual tape rewinding back onto the take-up reel, wherein the entire process of tape withdrawal and rewinding relative to the take-up reel occurs without creation of tape slack between the supply reel and the business machine. Upon release of the locking assembly to permit resumed supply reel rotation, normal control unit and business machine operation may be resumed.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view illustrating a paper tape control unit embodying the novel features of the invention and shown for use in combination with a business machine such as a calculator, adding machine or the like;

FIG. 3 is a transverse vertical sectional view taken generally on the line 3—3 of FIG. 2;

FIG. 4 is a vertical sectional view taken generally on the line 4—4 of FIG. 3;

FIG. 5 is an enlarged fragmented vertical sectional view generally corresponding with the encircled region 5 of FIG. 3;

FIG. 6 is an enlarged exploded perspective view illustrating further construction details of the components as shown in vertical section in FIG. 5;

DETAILED DESCRIPTION OF THE PREFERRED EMBODIMENT

Figure 1:
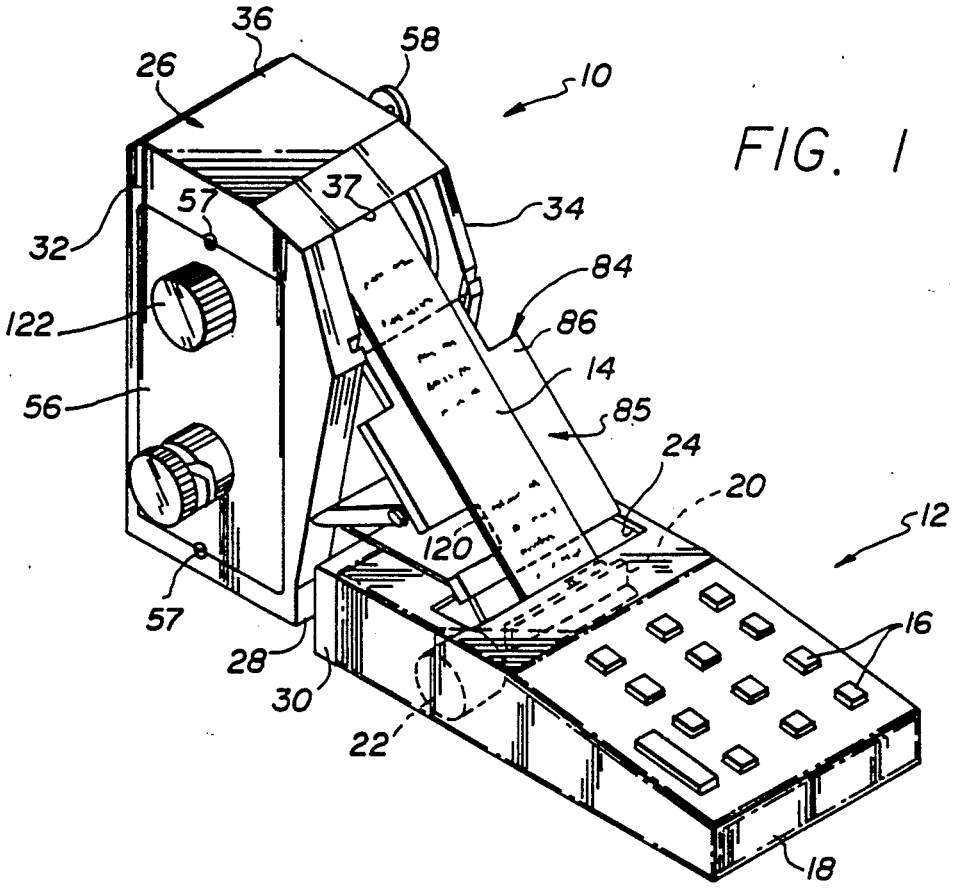

As shown in the exemplary drawings, an improved paper tape control unit referred to generally in FIG. 1 by the reference numeral 10 is provided for use in combination with a business machine 12 such as an adding machine, calculator or the like. The improved paper tape control unit 10 provides means for close, relatively simple, control of an elongated strip of paper tape 14, or the like, including means for controlled supply and controlled take-up of the paper tape 14 relative to the business machine 12.

The improved paper tape control unit 10 of the present invention provides a relatively simple yet versatile apparatus for enhanced handling of paper tape 14 in roll form with respect to calculators, adding machines and other business machines of the type requiring paper tape in elongated strip or roll form. The control unit 10 advantageously handles the paper tape 14 as it is supplied to and discharged from the machine 12 during normal operation all in a substantially slack-free manner and without significant risk of tape breakage. The control unit 10 rewinds paper tape in an efficient manner to prevent creation of unsightly tangled masses of used tape and further to permit reuse of the paper tape by printing, for example, on the reverse side thereof. Moreover, the improved control unit 10 beneficially enhances the functional versatility of the business machine 12 by facilitating the application of handwritten edits or notations onto used paper tape, and further by permitting a relatively easy review of used paper tape.

Figure 2:
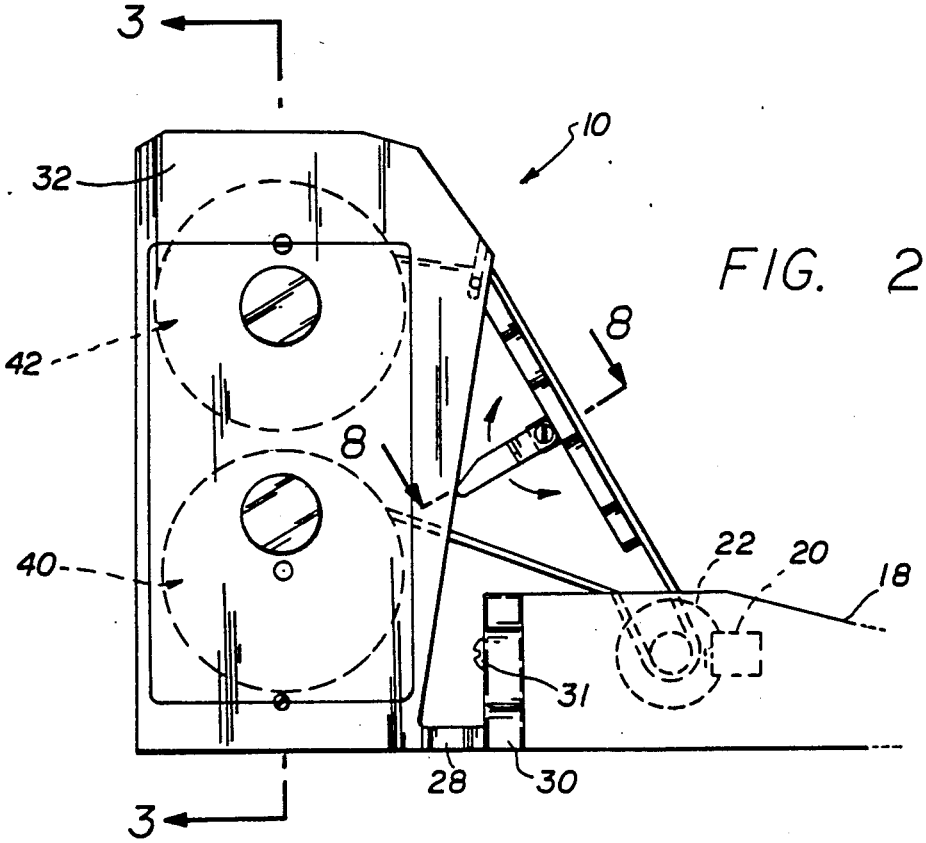
FIG. 2 is an enlarged left side elevation view illustrating the paper tape control unit and associated business machine.

As shown generally in FIGS. 1 and 2, the paper tape control unit 10 is designed to handle paper tape supply and discharge with respect to an adjacent business machine 12 of the type utilizing elongated strips or rolls of paper tape, such as the illustrative calculator. Business machines 12 of this general type traditionally include a plurality of operating keys or buttons 16 mounted in exposed positions on a machine housing 18 for appropriately actuating a printing head 20 located within the machine housing. This printing head 20 is positioned for printing appropriate symbols such as numbers or letters onto one side of the paper tape 14 as the tape is drawn into and through the machine 12, for example, by a traditional roller platen unit 22 or similar paper tape advancement means. In most business machines of this general type, the machine housing 18 further includes an appropriate mounting position for rotational mounting of a paper tape supply roll from which the paper tape is drawn by the roller unit 22. Used paper tape is usually discharged from the machine housing 18 through an upwardly open slot 24 for uncontrolled discharge from the machine. The traditional means on the machine housing 18 for rotationally supporting the paper tape supply roll is removed to accommodate use of the machine 12 in combination with the paper tape control unit 10 of the present invention.

In general, the improved paper tape control unit 10 comprises a relatively compact housing 26 designed to stand behind the associated business machine 12, as viewed in FIGS. 1 and 2. In this regard, in the illustrative embodiment of the invention the control unit housing 26 includes a base 28 having a relatively short connection foot 30 at a front end thereof for suitable connection, if desired, to a rear end of the business machine 12. Fastening means such as screws 31 or the like can be provided for securely connecting the control unit 10 with the business machine 12, although other types of relatively simple fastening components such as Velcro-type closure members or the like can be used to achieve this connection, as desired.

From the lower housing base 28 the control unit housing 26 includes a pair of upstanding side walls 32 and 34 conveniently interconnected at their upper ends by a top wall 36 which can include a forward tear edge 37. A rear closure wall 38 may also be provided as part of the housing 26, if desired. Importantly, however, the side walls 32 and 34 cooperate to define a generally hollow housing interior having an open front for direct exposure to the adjacent business machine 12.

A paper tape supply reel 40 is mounted within a lower region of the control unit housing 26 between the side walls 32 and 34, and a paper tape take-up reel 42 is mounted within the housing at a position directly above the supply reel 40. These supply and take-up reels 40 and 42 are rotatably supported within the housing 26 for rotational movement about generally parallel, preferably horizontal rotational axes which are oriented in parallel with the roller platen unit 22 or the like of the business machine 12. Accordingly, the supply and take-up reels 40 and 42 are positioned for smooth feeding of the paper tape 14 to the business machine with simultaneous smooth take-up winding of used paper tape from the machine.

More specifically, with reference to FIGS. 2–7, the supply reel 40 comprises a relatively small diameter spindle 44 having opposite ends 44' of reduced diameter to define bearing portions rotatably seated within aligned openings 45 and 46 formed respectively in the housing side walls 32 and 34. Near one end of the supply spindle 44, a relatively larger diameter side plate 48 is formed and carries an axially projecting drive pin 50 at a position spaced radially from the rotational axis of the drive spindle. In addition, the drive spindle 44 carries a relatively large diameter drive pulley 52 for rotation therewith, wherein this drive pulley 52 is located on the outboard side of the side wall 32 adjacent the side plate 48. As shown best in FIGS. 3–5, this drive pulley 52 is normally concealed within a shallow chamber 54 formed on the outboard side of the side wall 32, wherein this chamber 54 is normally closed on the outboard side by an overlying panel door 56 removably secured to the side wall 32 by screws 57 or the like.

The opposite side wall 34 of the housing 26 is removably connected by screws 58 (FIGS. 1 and 7) or the like, with mating pins and apertures cooperating between the side wall 34 and the remainder of the housing to insure proper mounting alignment. When this opposite side wall 34 is removed from the remainder of the housing 26, the entire housing interior is readily accessed to permit, for example, installation of a paper tape supply roll 60 (FIG. 7) onto the supply spindle 44. As is known in the art, this paper tape supply roll 60 comprises the elongated strip of paper tape 14 wound relatively snugly onto a drive cylinder 62, wherein the drive cylinder 62 is defined by concentric cylindrical walls separated by radial webs to form axially open drive pockets, one of which receives the drive pin 50 rotatable with the supply spindle 44. Accordingly, when the side wall 44 is reinstalled onto the housing 26 the supply roll 60 rotatably drives the drive spindle 44 as the paper tape 14 from the supply roll is drawn during normal use into association with the business machine 12.

The take-up reel 42 similarly comprises a relatively small diameter take-up spindle 64 sized to span between the housing side walls 32 and 34. The opposite ends of the take-up spindle 64 are reduced in diameter to define bearing portions 64' supported rotationally within aligned openings 65 and 66 in the side walls 32 and 34. The take-up spindle 64 also includes a relatively large diameter side plate 68 near one end thereof, positioned immediately above the drive spindle side plate 48, wherein the take-up spindle side plate 68 also includes an axially positioned drive pin 70 which is radially spaced from the rotational spindle axis.

The end of the take-up spindle 64 supported by the housing side wall 32 is connected to a driven pulley 72 (FIGS. 3 and 4). This driven pulley 72 is positioned on the outboard side of the side wall 32 within the shallow chamber 54 at a position directly above the drive pulley 52 associated with the supply reel 40. Drive belt means 74 preferably in the form of an elongated spring belt or the like is wrapped about the drive and driven pulleys 52 and 72 to insure relative rotation of both pulleys together during normal operation of the business machine 12 as will be described in more detail. The direction of pulley rotation and thus the directions of supply or take-up reel rotation is controlled by appropriate wrapping of the drive belt means 74, for example, in the figure eight geometry as illustrated in FIG. 4. Importantly, the relative diameters of the drive and driven pulleys 52 and 72 insure at least slightly faster rotational movement of the take-up reel 42, with the drive belt means and the pulleys accommodating slippage in the drive connection.

Figure 7:
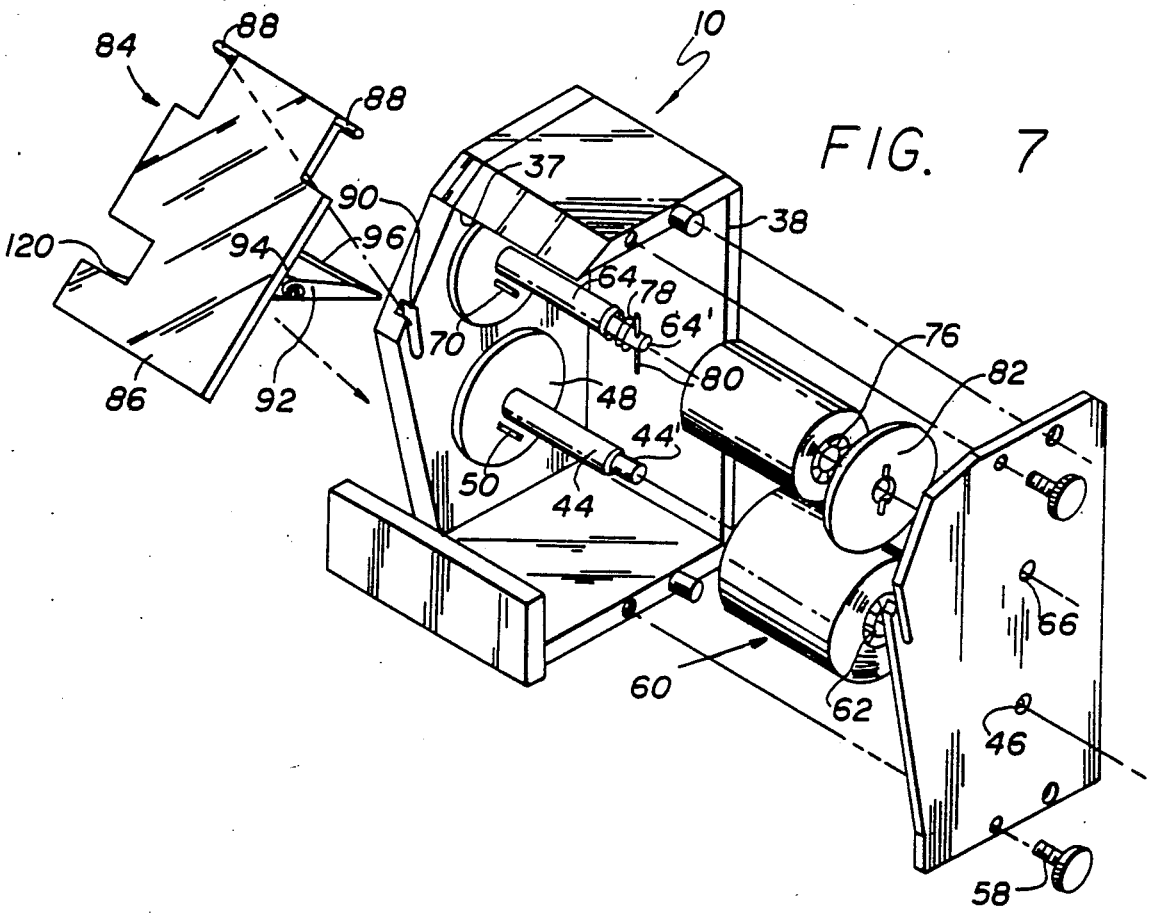
FIG. 7 is an exploded perspective view illustrating assembly and further construction details of the paper tape control unit.
Figure 8:
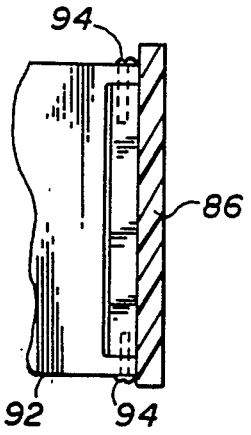
FIG. 8 is a fragmented sectional view taken generally on the line 8—8 of FIG. 2.

With reference to FIG. 7, removal of the opposite side wall 34 also permits a take-up drive cylinder 76 to be installed onto the take-up spindle 64, wherein the take-up drive cylinder 76 is similar in construction to the supply drive cylinder 62 and is thus drivingly engaged with the adjacent drive pin 50. To achieve improved positive driving, the take-up reel further includes a small compression spring 78 retained between the larger diameter central region of the take-up spindle 64 and a lock pin 80 near the end of the spindle 64, wherein the lock pin 80 receives a circular drive disk 82 onto the take-up spindle 64 in axially abutting relation with the exposed end of the adjacent drive cylinder 76. After installation of the drive disk 82, and with both supply and take-up reels mounted on their respective spindles, the removable side wall 34 can be quickly and easily reinstalled onto the housing by use of the screws 58 or the like to rotatably support the adjacent ends of the supply and take-up reels.

In normal operation, as shown in FIGS. 1 and 2, the paper tape 14 is drawn by the operational action of the business machine 12 into association with the machine printing head 20. Concurrently with this feeding or drawing movement of the paper tape from the supply reel 40, the drive and driven pulleys 52 and 72 impart a slightly faster rotational motion to the take-up reel 42. Such rotational motion of the take-up reel 42 rewinds used paper tape 14 discharged upwardly from the business machine 12 at a sufficient rate of speed to prevent any significant tape slack between the business machine and the control unit 10. The drive and driven pulleys 52 and 72 advantageously permit sufficient slipping motion relative to the drive belt means 74, whereby the desired faster rotation or overtravel of the take-up reel 42 does not create significant risk of tape breakage. Importantly, the sizes of the drive and driven pulleys are chosen to insure slightly faster take-up of the paper tape in comparison with the supply reel notwithstanding varying diametric sizes of the paper rolls on the respective supply and take-up drive cylinders 62 and 76.

In accordance with one primary feature of the invention, the paper tape control unit 10 includes an adjustable platen unit 84 mounted at the front of the housing 26 to provide a convenient flat writing surface 85 backing up the paper tape 14 as it is discharged from the machine 12. This writing surface 85 provides a convenient structure accommodating the application of edits or notations onto the paper tape discharged from the machine.

More particularly, the illustrative platen unit 84 comprises a relatively flat writing plate 86 defining the writing surface 85 and pivotally supported at an upper margin thereof by pins 88 or the like seated into aligned and upwardly open notches 90 in the two side walls 32 and 34. A central adjustment leg 92 is pivoted by pins 94 or the like to the rear side of this flat plate 86 and projects rearwardly to define a support edge 96 for engaging a forward margin of the side walls 32 and 34. Appropriate angular adjustment of this leg 92 relative to the flat plate 86 correspondingly orients the flat plate 86 at a selected optimum angle relative to the angle of tape discharge from the machine 12, and simultaneously supports the plate 86 is a stable manner to provide the desired writing surface 85.

In accordance with further important features of the invention, a locking assembly 98 is provided for releasably locking the supply reel 40 against rotation. More particularly, as shown best in FIGS. 3, 5 and 6, this locking assembly 98 is mounted on the removable panel door 56 at the side wall 32 and includes a short lock pin 100 projecting through the panel door 56 into the adjacent shallow chamber 54. A compression spring 102 reacts between an enlarged flange 104 on the lock pin and a base disk 106 secured onto the panel door 56 for normally urging an inboard end of the lock pin 100 for reception through an aligned one of a circular series of lock ports 108 formed in the drive pulley 52. When engaged with one of the lock ports 108, the lock pin 100 prevents rotation of the drive pulley 52, and thereby correspondingly prevents feeding of the paper tape 14 to the business machine 12.

The outboard end of the lock pin 100 is anchored within a control disk 110 which includes a radially offset guide pin 112 projecting into an arcuate, axially open guide slot 114 in the base disk 106. Accordingly, within the limits of the guide slot 114, the control disk 110 can be rotated relative to the base disk 106 thereby rotating the lock pin 100 about its own rotational axis. During such rotation of the control disk 106, engagable cam faces 116 and 118 on the base and control disks ride over one another to control lock pin advancement into one of the drive pulley lock ports 108. More particularly, rotation of the control disk in one direction axially retracts the lock pin 100 from the drive pulley 52 to permit drive pulley rotation and normal control unit operation, as described above. Reverse rotation of the control disk 110 advances the lock pin into engagement with one of the drive pulley lock ports to prevent drive pulley rotation.

With the drive pulley 52 locked by the lock pin 100 to prevent supply reel rotation, used paper tape 14 wound onto the take-up reel 42 can be withdrawn manually for editing and review. For this purpose, a side slot 120 in the flat plate 86 conveniently exposes one side edge of the paper tape for easy manual grasping and withdrawal from the take-up reel 42. Such withdrawal is accommodated with minimal resistance by the slip-drive connection between the supply and take-up reels. During such tape withdrawal for review purposes, the locked supply reel is prevented from rotating to prevent creation of undesirable paper tape slack between the supply and the business machine. Once this tape withdrawal and review has been completed, the reviewed paper tape can be rewound quickly and easily onto the take-up reel by means of a manually exposed knob 122 secured to one end of the take-up spindle 64 (FIGS. 1–3). As soon as the paper tape is fully rewound onto the take-up reel, the supply reel can be released for resumed rotation by appropriate rotation of the control disk 110, thereby retracting the lock pin 100 from the drive pulley 52.

Accordingly, the improved paper tape control unit 10 of the present invention provides a relatively simple yet highly versatile mechanism for controlling and handling paper tape relative to a business machine. The paper tape is handled efficiently and in a manner which beneficially prevents creation of undesired tape slack at all times. Moreover, the invention easily accommodates insertion of handwritten edits and notes onto the tape, and further permits periodic used tape winding reversal for review purposes without creating tape slack problems.

A variety of further modifications and improvements to the present invention are believed to apparent to those skilled in the art. Accordingly, no limitation on the invention is intended by way of the description and drawings herein, except as set forth in the appended claims.

What is claimed is:

1. A paper tape control unit adapted for use with a business machine or the like having means for drawing and using an elongated strip of paper tape, said control unit comprising:

a control unit housing;

a supply reel carrying a roll of paper tape in elongated strip form supply to the business machine;

a take-up reel for rewinding of the paper tape from said supply reel;

means for supporting said supply and take-up reels for rotation within said housing, said supply reel being positioned for drawing of said paper tape thereon into association with the business machine by operation of said drawing means for use of said paper tape by said business machine, said supply reel being rotatably driven by said drawing means as said paper tape is drawn from said supply means, and said take-up reel being positioned for rewinding thereonto of said paper tape used by said business machine;

drive means coupled between said supply and take-up reels such that rotational driving of said supply reel correspondingly rotatably drives said take-up reel for rewinding of said paper tape thereonto; and a lock assembly on said housing for releasably locking said supply reel against rotation, said drive means having sufficient slippage to permit manual rotation of said take-up reel when said supply reel is locked against rotation to permit withdrawal and review of a portion of said paper tape rewound onto said take-up reel and subsequent manual rewinding of said paper tape portion onto said take-up reel.

2. The paper tape control unit of claim 1 wherein said housing includes means for releasable connection to the business machine.

3. The paper tape control unit of claim 1 wherein said supply reel includes a drive pulley rotatable therewith and wherein said take-up reel includes a driven pulley rotatable therewith, said drive means comprising a drive belt coupled between said drive and driven pulleys.

4. The paper tape control unit of claim 3 wherein said drive belt comprises a spring belt.

5. The paper tape control unit of claim 3 wherein said lock assembly comprises a plurality of lock ports formed in said drive pulley in a generally circular array about the rotational axis of said drive pulley, a lock pin on said housing and movable between a locked position advanced into a selected one of said lock ports and an unlocked position retracted from said drive pulley, and means for selectively moving said lock pin between said locked and unlocked positions.

6. The paper tape control unit of claim 3 wherein said drive and driven pulleys are sized to insure at least slightly faster rotational driving of said driven pulley.

7. The paper tape control unit of claim 1 further including a writing platen unit carried on said housing in a position for passage thereover of paper tape used by the business machine upon displacement of the paper tape from the business machine toward said take-up reel for rewinding.

8. The paper tape control unit of claim 7 wherein said writing platen unit is removably mounted on said housing.

9. The paper tape control unit of claim 7 wherein said writing platen unit is adjustable to select the angular relation of a relatively flat writing surface defined thereby with respect to the orientation of the paper tape passing thereover.

10. A paper tape control unit adapted for use with a business machine or the like having means for drawing and using an elongated strip of paper tape and then for discharging used paper tape from the business machine, said control unit comprising:

a control unit housing having a pair of spaced apart, generally upstanding side walls;

a supply reel carrying a roll of paper tape and mounted rotatably within said housing between said side walls, said housing being adapted for positioning relative to the business machine for drawing of said paper tape from said supply reel by said drawing means for use of said paper tape by the business machine, said supply reel being rotatably driven by said drawing means upon drawing of said paper tape from said supply reel;

a take-up reel mounted rotatably within said housing between said side walls, said housing supporting said take-up reel in parallel relation with said supply reel, said take-up reel being positioned for rewinding thereonto of said paper tape discharged from the business machine;

drive means interconnecting said supply and take-up reels whereby rotatable driving of said supply reel by said drawing means imparts rotational motion to said take-up reel;

a lock assembly on said housing for selectively and releasably locking said supply reel against rotation, said drive means having sufficient slippage to permit manual rotation of said take-up reel when said supply reel is locked against rotation; and means forming a writing platen carried by said housing in a position for passage thereover of used paper tape discharged from the business machine prior to rewinding of said paper tape onto said take-up reel.

11. The paper tape control unit of claim 10 wherein said housing includes means for releasable connection to the business machine.

12. The paper tape control unit of claim 10 wherein said supply reel includes a drive pulley rotatable therewith and wherein said take-up reel includes a driven pulley rotatable therewith, said drive means comprising a drive belt coupled between said drive and driven pulleys.

13. The paper tape control unit of claim 12 wherein said drive belt comprises a spring belt.

14. The paper tape control unit of claim 12 wherein said lock assembly comprises a plurality of lock ports formed in said drive pulley in a generally circular array about the rotational axis of said drive pulley, a lock pin on said housing and movable between a locked position advanced into a selected one of said lock ports and an unlocked position retracted from said drive pulley, and means for selectively moving said lock pin between said locked and unlocked positions.

15. The paper tape control unit of claim 10 wherein said drive and driven pulleys are sized to insure at least slightly faster rotational driving of said driven pulley.

16. The paper tape control unit of claim 10 wherein said writing platen comprises a relatively flat plate and means for supporting said plate from said housing in one of a plurality of angularly adjustable positions.

17. The paper tape control unit of claim 10 wherein said writing platen comprises a relatively flat plate having a slot in one side thereof to expose one side edge of said paper tape for manual grasping.

18. A paper tape control unit for use in combination with a business machine or the like having means for drawing and using an elongated strip of paper tape and for discharging used paper tape from the business machine, said control unit comprising:

a supply reel carrying a roll of paper tape for association with said drawing means;

means for rotatably supporting said supply reel whereby said supply reel is rotatably driven upon drawing of the paper tape therefrom by said drawing means;

a take-up reel for rewinding of the paper tape discharged from the business machine;

means for rotatably supporting said take-up reel;

drive means for drivingly interconnecting said supply and take-up reels whereby said take-up reel is rotatably driven upon rotation of said supply reel;

lock means for releasably and selectively locking said supply reel against rotation, said drive means having sufficient slippage to permit rotation thereof when said supply reel is locked against rotation; and knob means coupled to said take-up reel and manually rotatable for manually rotating said take-up reel.

19. The paper tape control unit of claim 18 further including an adjustably positioned writing platen defining a relatively flat writing surface disposed for passage thereover of the paper tape discharged from the business machine prior to rewinding onto said take-up reel.

20. The paper tape control unit of claim 18 wherein said business machine comprises a calculating machine.

* * * * *